US007369795B2

(12) United States Patent
Funamoto et al.

(10) Patent No.: US 7,369,795 B2
(45) Date of Patent: May 6, 2008

(54) IMAGE FORMING APPARATUS EFFECTIVELY PRODUCING QUALITY COLOR IMAGE WITHOUT CAUSING COLOR SLIPPAGE

(75) Inventors: Noriaki Funamoto, Yokohama (JP); Joh Ebara, Kamakura (JP); Toshiyuki Uchida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 11/342,724

(22) Filed: Jan. 31, 2006

(65) Prior Publication Data

US 2006/0182465 A1 Aug. 17, 2006

(30) Foreign Application Priority Data

Jan. 31, 2005 (JP) ..... 2005-022819

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS 7,206,537 B2 * 4/2007 Funamoto et al. ..... 399/167
2005/0058470 A1 3/2005 Funamoto et al.
2005/0084293 A1 4/2005 Fukuchi et al.
2005/0207799 A1 9/2005 Ebara

FOREIGN PATENT DOCUMENTS

JP 09-146329 6/1997
JP 2001-305820 11/2001

OTHER PUBLICATIONS

U.S. Appl. No. 11/500,306, filed Aug. 8, 2006, Funamoto.

* cited by examiner

*Primary Examiner*—David M. Gray
*Assistant Examiner*—Ruth N LaBombard
(74) *Attorney, Agent, or Firm*—Oblon, Spivak, McClelland, Maier & Neustadt, P.C.

(57) ABSTRACT

An image forming apparatus includes a plurality of process cartridges. Each process cartridge includes an image carrier configured to form an image intermediately, a drive transfer member engaged with the image carrier, a drive mechanism configured to drive to rotate the image carrier via the drive transfer member, a marking member mounted on the drive transfer member and configured to indicate a rotational position of the drive transfer member, a detector configured to detect the rotational position by detecting the marking member, and a balancer mounted on the drive transfer member configured to match a weighted center of the drive transfer member with a shaft center of the image carrier. A controller is configured to adjust rotational phases of the image carriers based on results detected by the detector.

16 Claims, 12 Drawing Sheets

FRONT SIDE

BACK SIDE

FRONT SIDE

BACK SIDE

IMAGE FORMING APPARATUS EFFECTIVELY PRODUCING QUALITY COLOR IMAGE WITHOUT CAUSING COLOR SLIPPAGE

This patent specification is based on Japanese patent application, No. JP2005-022819 filed on Jan. 31, 2005 in the Japan Patent Office, the entire contents of which are hereby incorporated by reference herein.

BACKGROUND OF THE INVENTION

1. Field of the Invention

The present invention relates to an image forming apparatus effectively producing quality color image without causing color slippage.

2. Discussion of the Background

A background color image forming apparatus generally includes a plurality of photosensitive drums as image carriers. It is known that there is a color slippage problem on a formed image due to a deviation of rotational speed shifts at each photosensitive drum. Each photosensitive drum is generally unified with a drive transfer member engaging with each other photosensitive drum and is driven by a driving force via the drive transfer members.

The deviation of rotational speed shifts is caused by an accuracy error and an eccentricity generated at an attachment process of the drive transfer member. Although this problem has been studied, no clear solution to solving this problem has yet been obtained. It has been proposed to adjust each phase of a rotational speed shift to a phase of a rotational speed shift of a drive transfer member so that an amount of color slippage is minimized by restraining the deterioration of image quality.

More specifically, a background method for adjusting the rotational speed shift is to adjust a phase of the each rotational speed shift within a predetermined minimum range. And the method includes the following procedure. At first, color slippage adjusting patterns are formed on intermediate carriers such as intermediate transfer belts and then are read by pattern detection apparatuses. The rotational speed shift and the amount of phase shift on each photosensitive drum axis are calculated.

Further, phase differences between the photosensitive drums are calculated until getting a result for achieving a minimum amount of color slippage. The result of the phase information is stored as profile data in a storage device, such as a rewritable nonvolatile memory. Then, phase relationships of the photosensitive drums are adjusted to follow the profile data calculated based on the phase information before an image forming process.

In the background image forming system, a base mark (marking) which shows a rotating position is arranged at each drive gear and a dedicated member of a photosensitive drum to adjust to follow the profile data. Marking detection sensors are arranged firmly at a main unit of the apparatus to detect the marking.

The markings of the photosensitive drums are detected by the marking detection sensors at every rotation. Then, differences of detection timing of the markings are determined. Based on the difference, each drive motor for driving each photosensitive drum is controlled to align the rotation phase to a phase of a photosensitive drum.

Namely, in this configuration, a detection signal is transmitted when a marking is passing through a detection zone during a rotation of each photosensitive drum. Then, the rotation phase is calculated from the timing differences of the transmitted signals. Then, each rotation phase is aligned by controlling the drive motor for each photosensitive drum in a predetermined manner to the profile data previously determined.

In this background configuration, the phase relationships between photosensitive drums are determined using the signals detected while each marking is passing through the marking detection sensor in accordance with the rotation of each photosensitive drum. For this reason, it may take a relatively long time to print a first page.

For example, when a position of the marking on the drive transfer member is in a position where it is just passing over the marking detection sensor at a start timing of a phase detection procedure, it is needed to wait until the marking rotates almost one more turn and passes through the marking detection sensor. This causes a time lag for detection and makes a delay for the first page printing.

To solve this time lag problem, it has been proposed to make a marking larger and to place a plurality of the markings, to detect the markings more efficiently and determine the rotation position in a shorter time. More specifically, it has been proposed to arrange a longer marking in a rotating direction and a plurality of markings that have different lengths on a circumference.

SUMMARY OF THE INVENTION

With the above configuration, it is possible to detect markings more efficiently and determine a phase difference in a shorter time than in an image forming apparatus without such markings. However, a weighted center of the drum drive transfer gear and dedicated members in a vertical direction deviate from a shaft center of the photosensitive drum due to the larger marking or the plurality of markings. As a result, there may arise a speed shift problem due to a shift of the weighted center.

Thus, there is an increasing demand to obtain an image forming apparatus that produces quality color image without causing color slippage due to rotation speed shift of the image carriers.

This patent specification describes a novel image forming apparatus that includes a plurality of process cartridges, each of which includes an image carrier configured to form an image intermediately, a drive transfer member engaged with the image carrier, a drive mechanism configured to drive to rotate the image carrier via the drive transfer member, a marking member mounted on the drive transfer member and configured to indicate a rotational position of the drive transfer member, a detector configured to detect the rotational position by detecting the marking member, a balancer mounted on the drive transfer member and configured to match a weighted center of the drive transfer member with a shaft center of the image carrier, and a controller configured to adjust rotational phases of the image carriers based on results detected by the detector.

This patent specification further describes a novel feature of a novel image forming apparatus that includes a plurality of strengthening ribs configured to strengthen the drive transfer member and at least one of the strengthening ribs have a different height from the height of the other strengthening ribs so that a weighted center of the drive transfer member matches with a shaft center of the image carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
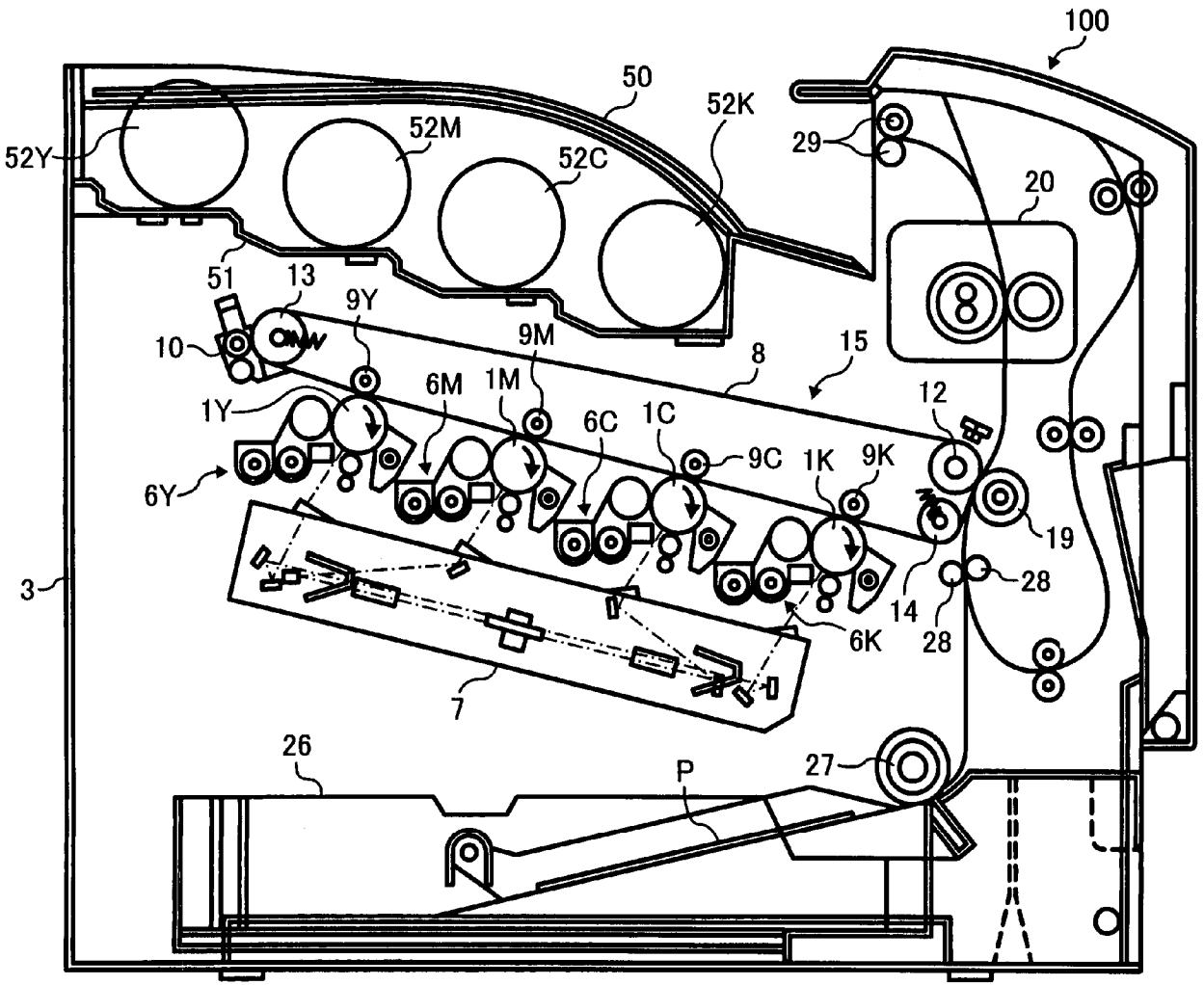
FIG. 1 illustrates a printer as an image forming apparatus to which the present invention can be applied.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus according to an embodiment of the present invention is described.

Figure 2:
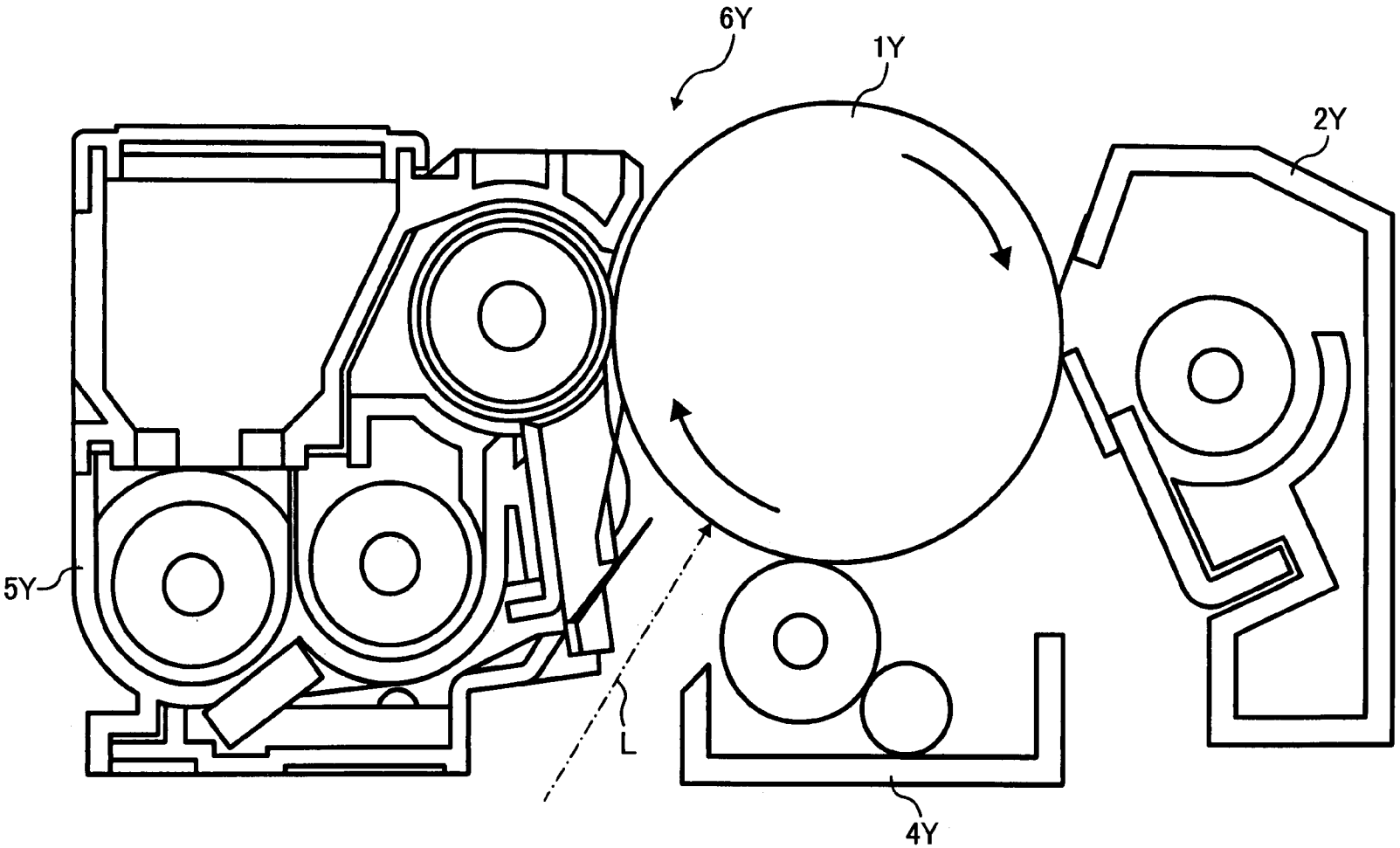
FIG. 2 illustrates a relevant part of the image forming apparatus of FIG. 1.
Figure 3:
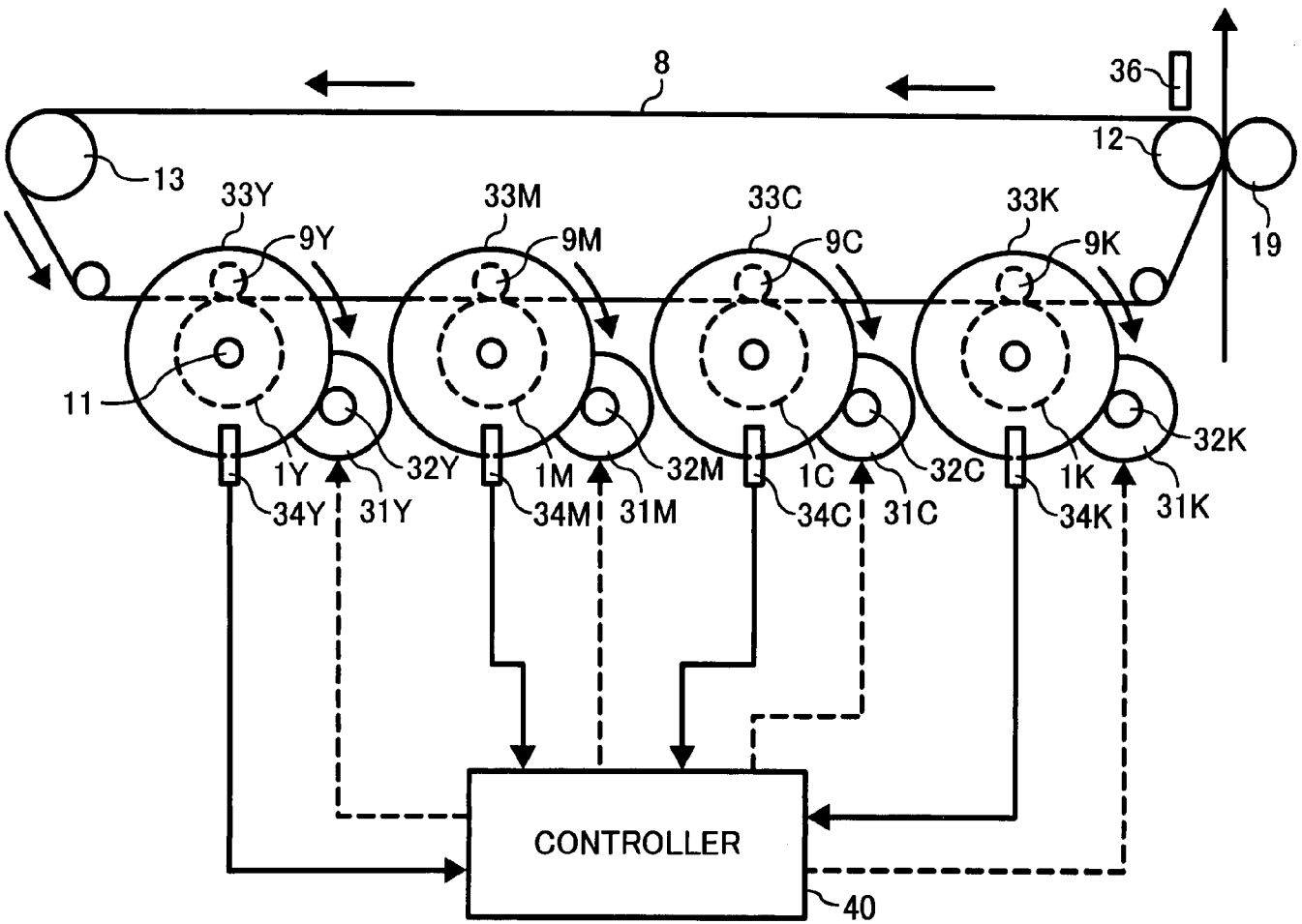
FIG. 3 is a front view of a configuration of a drive mechanism of the image forming apparatus.

FIG. 1 illustrates a printer 100 as an image forming apparatus according to an exemplary embodiment. In FIG. 1, a whole configuration of the printer is illustrated. FIG. 2 illustrates a front inside view of a process cartridge. FIG. 3 is a front view of a configuration of a drive mechanism which includes a controller to control photosensitive drums used as image carriers.

Figure 4:
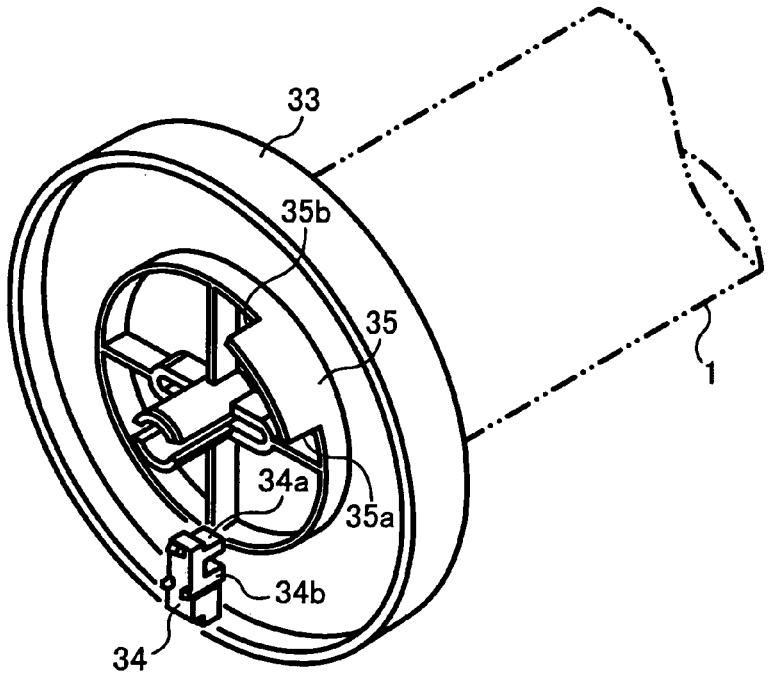
FIG. 4 is an illustration of an oblique perspective view of a drum drive gear to explain the detection procedure.
Figure 5:
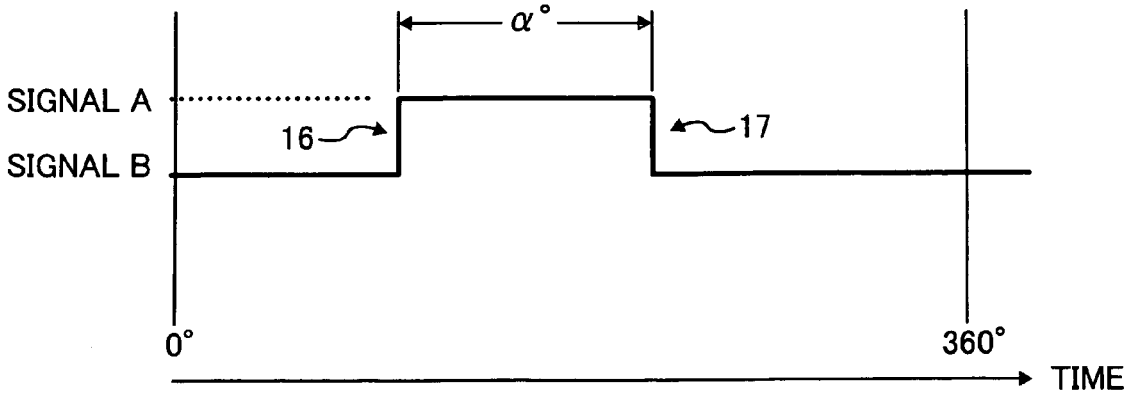
FIG. 5 is an illustration of a waveform of a signal detected by a positional detection sensor.

FIG. 4 illustrates an oblique perspective view of the drum drive gear of an image carrier working as a drive transmission member which includes a background marking. FIG. 5 is an illustration of a waveform which shows detection positions.

Figure 6:
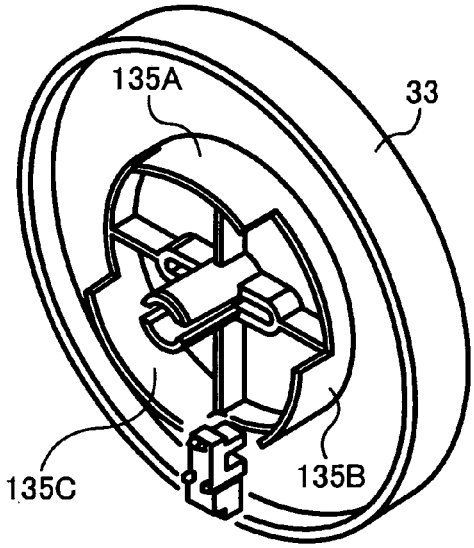
FIG. 6 is an illustration of an oblique perspective view of another drum drive gear to explain the detection procedure.
Figure 7:
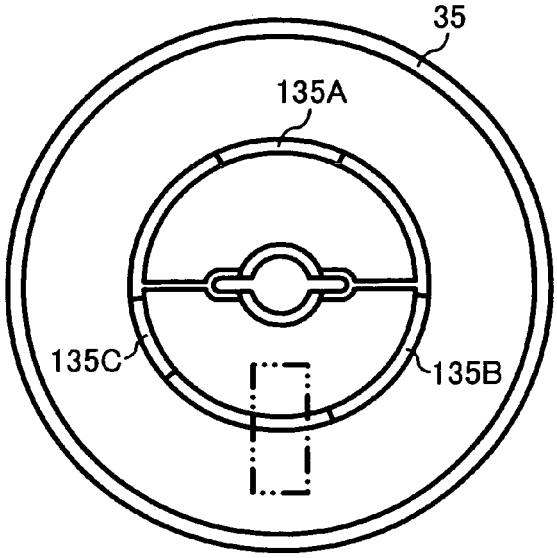
FIG. 7 is a magnified front view of the drum drive gear of FIG. 6.
Figure 8:
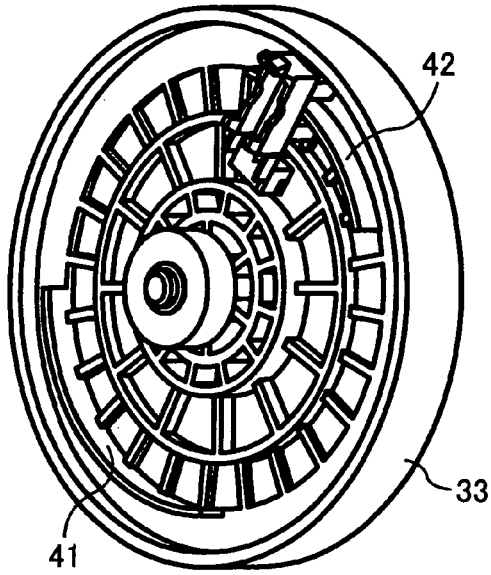
FIG. 8 is an illustration of an oblique perspective view of another drum drive gear to explain the detection procedure.
Figure 9:
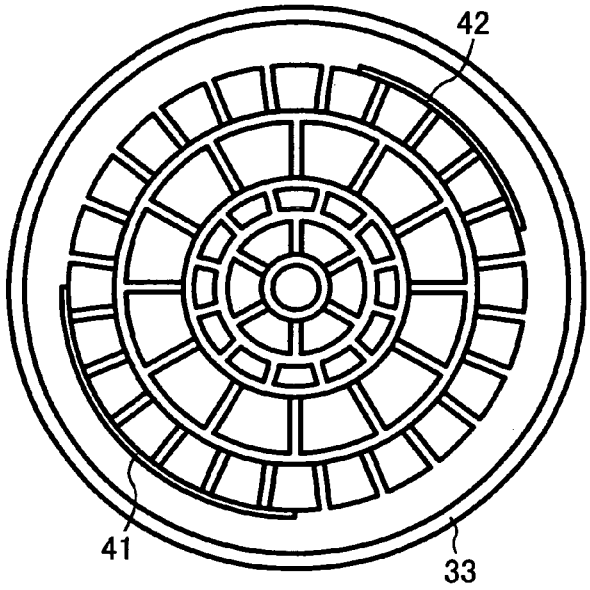
FIG. 9 is a magnified front view of the drum drive gear of FIG. 8.
Figure 10:
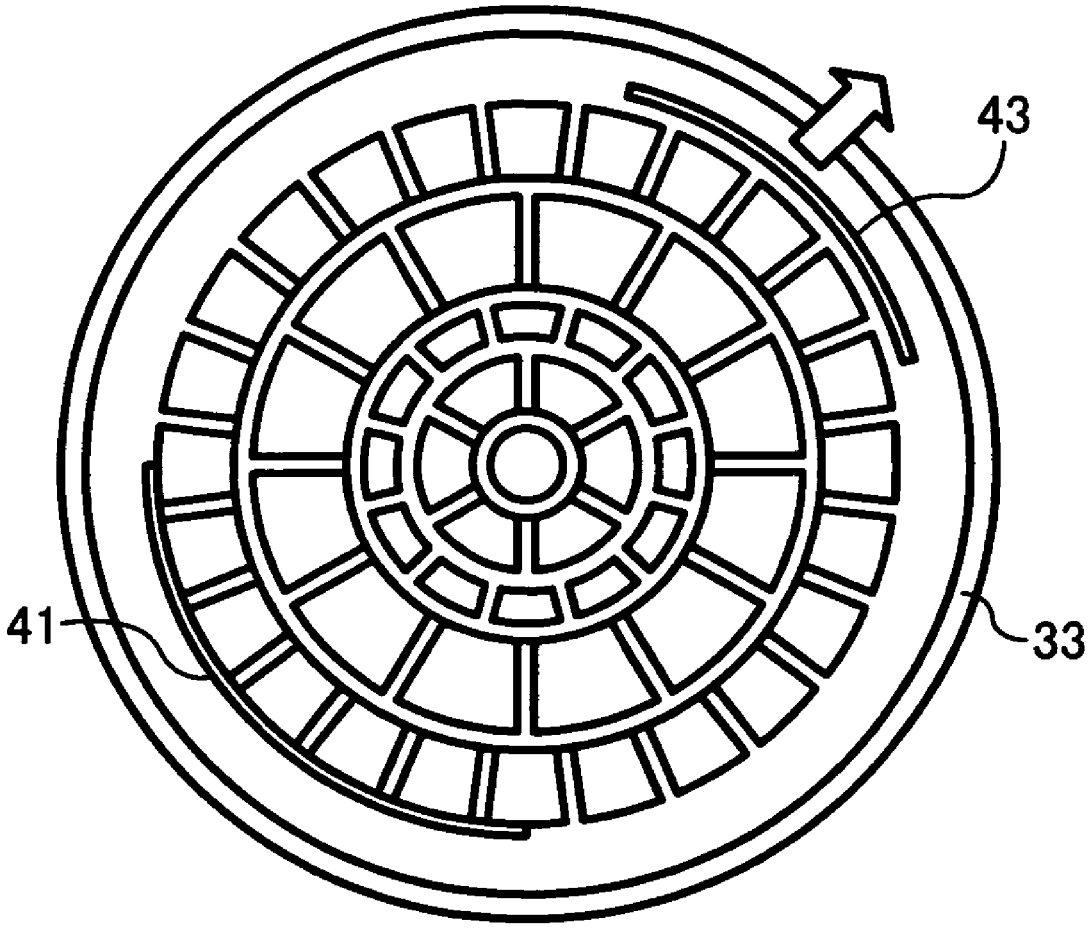
FIG. 10 is a magnified front view of a drum drive gear of an exemplary embodiment of the present invention.

FIGS. 6 and 7 illustrate oblique perspective views of another drum drive gear which includes three conventional markings. FIG. 6 is an oblique perspective view of the drum drive gear and FIG. 7 is a front view of the drum drive gear. FIGS. 8 and 9 illustrate another drum drive gear that includes two background markings to explain the detection procedure. FIG. 8 is an oblique perspective view of the drum drive gear and FIG. 9 is a front view of the drum drive gear. FIG. 10 is a magnified front view of a drum drive gear which includes a marking and a corresponding member according to the first exemplary embodiment.

As shown in FIGS. 1, 2, and 3, the printer 100 includes an intermediate transfer belt 8, photosensitive drums 1Y, 1M, 1C and 1K, drive motors 31Y, 31M, 31C and 31K, a positional detection sensors 34, and a controller in a main unit 3. The intermediate transfer belt 8 is an intermediate image carrier and tentatively holds a toner image which is transferred to a paper P, i.e. a final target of an image fixing process.

The photosensitive drums 1Y, 1M, 1C and 1K are configured to work as a plurality of image carriers and arranged to touch the intermediate transfer belt 8. The drive motors 31Y, 31M, 31C and 31K are a plurality of drive mechanisms and drive to rotate the photosensitive drums 1Y, 1M, 1C and 1K via drum drive gears (drive transfer members) that are engaged with the photosensitive drums 1Y, 1M, 1C and 1K.

The positional detection sensors 34Y, 34M, 34C and 34K are used to detect a rotational position of the photosensitive drums 1Y, 1M, 1C and 1K. The controller makes all the plurality of photosensitive drums to rotate and controls the rotations of the photosensitive drums 1Y, 1M, 1C and 1K with a predetermined manner in accordance with the phase information of the photosensitive drums 1Y, 1M, 1C and 1K detected by the positional detection sensors 34Y, 34M, 34C and 34K. Namely, the controller controls to adjust phases of the plurality of the photosensitive drums 1Y, 1M, 1C and 1K by changing the rotation speed or changing start and stop timing with respect to each photosensitive drum.

The printer 100 includes four process cartridges 6Y, 6M, 6C and 6K. The process cartridges 6Y, 6M, 6C and 6K generate toner images to form images visual with colors of yellow (Y), magenta (M), cyan (C) and black (B). The process cartridges 6Y, 6M, 6C and 6K include the photosensitive drums 1Y, 1M, 1C and 1K configured to be rotatablely held about rotation axes that are in a horizontal direction. And a part of surface of the photosensitive drums 1Y, 1M, 1C and 1K is formed to be exposed to an outside of the process cartridges 6Y, 6M, 6C and 6K. And that part of the surface photosensitive drums 1Y, 1M, 1C and 1K are arranged in the main unit 3 to touch the intermediate transfer belt 8. With this configuration, a color toner image, which is processed at the photosensitive drums, is formed on each surface of the photosensitive drums 1Y, 1M, 1C and 1K.

The process cartridges 6Y, 6M, 6C and 6K have basically a similar configuration and contain Y-toner, M-toner, C-toner and B-toner as image forming materials respectively. The process cartridge is considered to be treated as a consumable component. Therefore, it is removably attached so as to be exchanged with a new process cartridge at an end of an operating life of the process cartridge.

FIG. 2 illustrates the configuration of the process cartridge 6Y. The other process cartridges 6M, 6C and 6K have a similar configuration to the process cartridge 6Y. The process cartridge 6Y includes a photosensitive drum 1Y as an image carrier. Around the photosensitive drum 1Y of the process cartridge 6Y at least one of a drum cleaning unit 2Y, a neutralization unit, a charging unit 4Y, and a development unit 5Y are arranged in order from upstream to downstream in a direction of rotation of the photosensitive drum 1Y.

The photosensitive drum 1Y is configured to be driven to rotate about a horizontal axis of the photosensitive drum 1Y while being installed in the main unit 3. The charging unit 4Y includes a charging roller which is charged with a predetermined voltage and rotates in accordance with the rotation of the photosensitive drum 1Y. The charging unit 4Y uniformly charges up the surface of the photosensitive drum 1Y while rotating. On the charged surface of the photosensitive drum 1Y, an electrostatic latent image of Y-image is formed by irradiating and scanning a laser beam L.

The development unit 5Y includes a development roller. The development roller is arranged to be positioned with a predetermined small gap to the surface of the photosensitive drum 1Y and is configured to rotate in accordance with the rotation of the photosensitive drum 1Y. A toner brush is formed on the development roller. The Y-toner on the toner brush moves to the surface of the photosensitive drum 1Y. Then, an Y electrostatic latent image formed on the surface of the photosensitive drum 1Y is visualized as a Y-toner image with Y-toner by the development unit 5Y. The Y-toner image is transferred intermediately onto the intermediate transfer belt 8.

The drum cleaning unit 2Y includes a cleaning blade. The cleaning blade is arranged to touch the surface of the photosensitive drum 1Y with an edge of the cleaning blade with a predetermined angle and voltage. After the intermediate transfer process, the residual toner carried on the surface of the photosensitive drum 1Y is removed by the cleaning blade.

The charging unit 4 neutralizes the residual charge carried on the surface of the surface of the photosensitive drum 1Y after the cleaning process. Then, the surface of the photosensitivre drum 1Y is initialized by this neutralization process to prepare for a next image forming process.

Similarly on the other process cartridges 6M, 6C and 6K, M-toner image, C-toner image and K-toner image are formed on the respective photosensitive drums 1M, 1C and 1K. Finally, the four toner images are superimposed and are transferred onto the intermediate transfer belt 8.

As shown in FIG. 1, an exposure apparatus 7 is arranged underneath of the process cartridges 6Y, 6M, 6C and 6K. The exposure apparatus 7 is a latent image forming apparatus and laser beams are exposed to the photosensitive drums 1Y, 1M, 1C and 1B of the process cartridges 6Y, 6M, 6C and 6K in accordance with an image information. With the laser exposure, a Y-latent image, M-latent image, C-latent image and K-latent image are formed on the photosensitive drums 1Y, 1M, 1C and 1K.

The exposure apparatus 7 scans the laser beam L by a polygon mirror which is driven to rotate by a motor. The laser beam L is exposed to the photosensitive drums 1Y, 1M, 1C and 1K via a plurality of lenses and mirrors. Thus, the exposure apparatus 7 is one of a visual image forming mechanism that forms visual images on the photosensitive drums 1Y, 1M, 1C and 1K.

Moreover, a paper feed apparatus is arranged underneath of the exposure apparatus 7. The paper feed apparatus includes a paper storage cassette 26. In the paper storage cassette 26, a paper feed roller 27 and a pair of resist rollers 28 are included. A plurality of paper sheets P are stored in the paper storage cassette 26 and the paper feed roller 27 touches the top sheet of the piled paper sheets.

The top paper is only fed to a carrier track toward a nip of the resist rollers 28 when the paper feed roller 27 is forced to rotate in a counterclockwise direction by a driving device such as a motor (not shown). The resist rollers 28 are rotated to get the paper sheet and are stopped to rotate to hold the paper sheet after getting the paper sheet. Then, the resist rollers 28 send the paper sheet to a secondary transfer nip at a proper timing for transferring a toner image onto the intermediate transfer belt 8.

At an upper side of the process cartridges 6Y, 6M, 6C and 6K, an intermediate transfer unit 15 is arranged. In the intermediate transfer unit 15, the intermediate transfer belt 8 is extended among rollers endlessly. The intermediate transfer unit 15 includes a belt cleaning unit 10, four first transfer bias rollers 9Y, 9M, 9C and 9K, a secondary backup roller 12, a cleaning backup roller 14, and a tension roller 13 besides the intermediate transfer belt 8. Thus, the intermediate transfer belt 8 is extended among these seven rollers and is moved endlessly in a counterclockwise direction by a drive force from one of the seven rollers.

The first transfer bias rollers 9Y, 9M, 9C and 9K form first transfer nips with the photosensitive drums 1Y, 1M, 1C and 1K at the intermediate transfer belt 8. At each first transfer nip, a potential (for example, a positive potential), which is an opposite polarity to a charge on toner, is applied at an inner side of the intermediate transfer belt 8 as a transfer bias. All the rollers in the intermediate transfer unit 15 are grounded except the first transfer bias rollers 9Y, 9M, 9C and 9K.

While the intermediate transfer belt 8 is moving endlessly and is passing through each nip, a Y-toner image, M-toner image, C-toner image and K-toner image on each of the photosensitive drums 1Y, 1M, 1C and 1K are transferred and superimposed. Then, a four color toner image (4-color toner image) is formed. The intermediate transfer unit 15 includes a contact mechanism (not shown) that forces and separates the photosensitive drum to and from the intermediate transfer belt 8.

The secondary backup roller 12 forms a secondary transfer nip with the secondary transfer roller 19 at the intermediate transfer belt 8. The 4-color toner image formed on the intermediate transfer belt 8 is transferred to the paper sheet P. Then, the 4-color toner image and a white colored paper realize a full color toner image. The surface of the intermediate transfer belt 8 is cleaned by the cleaning apparatus 10 because the surface of the intermediate transfer belt 8 holds residuals of toner which are not transferred accidentally while passing through the secondary transfer nip.

The paper sheet P, which is at the secondary transfer nip of the intermediate transfer belt 8 and the secondary transfer roller 19, is forwarded further to an upper side of the carrier track opposite to the resist rollers 28. While the paper sheet P is being sent from the secondary transfer nip and is passing through rollers at the fixing apparatus 20, a color toner image is fixed on the surface of the paper sheet with heat and pressure. Finally, the paper sheet P is output to outside of the printer 100 via a pair of output rollers 29.

On the main body 3 of the printer 100, a paper stack section 50 is arranged. The paper sheets output from the output rollers 29 are piled one by one in the paper stack section 50. Between the intermediate transfer unit 15 and the paper stack section 50, a bottle storage section 51 is arranged.

Toner bottles 52Y, 52M, 52C and 52K that each contain corresponding color toner are set in the bottle storage section 51. Each color toner stored in each toner bottle is fed to the development unit in the process cartridge when the toner is needed to be supplied.

Each toner bottle 52Y, 52M, 52C and 52K is arranged removably to the main body 3 of the printer 100 independently from the other process cartridges. If the toner bottle is exhausted due to a toner supply to the process cartridge, the empty toner bottle is exchanged with a new toner bottle 52Y, 52M, 52C and 52K which contains toner fully.

FIG. 3 is a schematic of the relevant part of the printer 100 viewed from a direction of the shaft of each photosensitive drum 1Y, 1M, 1C and 1K. As shown in FIG. 3, drum driving gears 33Y, 33M, 33C and 33K are arranged at each end of the shaft of photosensitive drums 1Y, 1M, 1C and 1K. Each shaft of the drum driving gears 33Y, 33M, 33C and 33K is engaged with a joint member to the drum shaft of the photosensitive drums 1Y, 1M, 1C and 1K. Thus, the drum driving gears 33Y, 33M, 33C and 33K are integrated with the photosensitive drums 1Y, 1M, 1C and 1K so as to rotate with the photosensitive drums 1Y, 1M, 1C and 1K.

Namely, the gear shafts (not shown) of the drum driving gears 33Y-33K are engaged with the respective drum shafts 11 of the photosensitive drums 1Y-1K and arranged in a line via the joint member, which is arranged at each end of the drum shaft 11 so as to rotate together as a unified device. Moreover, the photosensitive drums 1Y-1K are configured to be removable from the drum driving gears with this configuration.

More specifically, first and second couplings are arranged at each end of the drum driving gear and the drum shaft 11. The first coupling is fixed at the end of the drum shaft 11 and is a first engagement member which works as joint member to rotate together with the drum shaft 11. On the other hand, the second coupling is fixed at the end of the drum drive gear shaft and is a second engagement member which works as joint member to rotate together with the drum driving gear.

When the process cartridges 6Y-6K are set and installed in the predetermined positions of the main body 3 of printer 100, the first coupling, which is the first engagement member at the driven equipment, engages with the second coupling, which is the second engagement member at the drive equipment, so as to transmit a rotation driving force. It is easy to release the engagements between the shafts because the joint members are used.

The rotation driving force is transmitted to each drum driving gear 33Y-33K from the drive motors 31Y-31K so that the photosensitive drums are driven to rotate. The drum driving gears 33Y-33K have a toothed wheel structure on which teeth are formed along the outer circumference of the wheel. The drum driving gears 33Y-33K are engaged with drive transfer gears 32Y, 32M, 32C and 32K, each of which also has a toothed wheel structure with a smaller diameter than the drum driving gears 33Y-33K so as to transmit the rotation driving force.

The outer circumference of the drum driving gear (top surface of the teeth) is formed to have a flat surface with a friction layer so that the rotation drive force can be transmitted by a frictional engagement with an assistance of a necessary amount of pressure. Therefore, when the frictional engagement configuration to transmit the driving power is adopted, a collision noise can be effectively eliminated during an image forming operation so as to achieve a low noise printer.

Each drive transfer gear 32Y, 32M, 32C and 32K is fixed and arranged to the output part of the shaft of the drive motors 31Y, 31M, 31C and 31K independently at the main body 3 of the printer 100. And each drive transfer gear 32Y, 32M, 32C and 32K is driven to rotate independently of other drive transfer gears. Further, the drive motors 31Y, 31M, 31C and 31K are arranged at each respective photosensitive drum 1Y, 1M, 1C and 1K. Therefore, each rotation of the photosensitive drum can be controlled independently.

Namely, using this configuration to transmit with one connecting gear, a driving force can be transmitted without any gear therebetween to the drum drive gears 33Y-33K which are rotated with the photosensitive drums 1Y-1K. Therefore, the rotations of the photosensitive drums can be controlled precisely with high transmission efficiency.

The controller 40 controls a rotation speed of the output shaft, a timing for starting to rotate, and a timing for stopping with respect to the drive motors 31Y, 31M, 31C and 31K. The controller 40 includes I/O ports, CPU, ROM and RAM and also controls a whole process of the printer 100. A driving circuit is wired to the controller 40 to supply powers to the drive motors 31Y-31K. In accordance with a signal from the controller 40, the powers are supplied with predetermined power supply timings, voltages, current capacities, and frequencies. Further, the powers are appropriately stopped from being supplied. The necessary conditions for the rotation such as a rotation speed and a phase of timing are also controlled.

Positional detection sensors 34Y, 34M, 34C and 34K are arranged and configured to detect rotational positions of the photosensitive drum 1Y-1K and are wired to the controller 40. The controller 40 is configured to recognized the rotational positions based on the signals output from the detection sensors 34Y, 34M, 34C and 34K. Namely, the controller 40 controls the drive motors 31Y, 31M, 31C and 31K based on the detected signals so that the photosensitive drums 1Y-1K are controlled to minimize color slippage of the image transferred on the transfer belt.

A read image sensor 36 is arranged above the intermediate transfer belt 8 with an image pickup device facing the intermediate transfer belt 8. The read image sensor 36 is wired to the controller 40. Therefore, a toner image on the intermediate transfer belt 8 is read and then the read toner image is output to the controller 40.

A process sequence used in this example, which begins at the detection of phase difference of the photosensitive drums and ends at the control of the phase difference, is similar to a background procedure. Correlation data is taken to specify correlation of rotation positions to minimize toner image shifts among color toner images. Then, the correlation data is stored in a memory included in the controller 40 as a storage. A variety of storages such as a RAM (random access memory) and S-RAM (static-random access memory) with non-volatile elements can be used for the memory.

The controller 40 controls the drive motors 31Y, 31M, 31C and 31K so as to fit the correlation of rotation positions to the correlation data stored in the memory. In this example, the rotation positions of the photosensitive drums 1Y, 1M and 1C are adjusted to the rotation position of the photosensitive drum 1K. More specifically, for example, the rotation speed of the photosensitive drums 1Y, 1M and 1C are increased or decreased to adjust their rotation positions.

The rotations of the photosensitive drums 1Y, 1M, 1C and 1K are adjusted so that the correlation of the rotation positions among the photosensitive drums fit the predetermined correlation data when the rotation speeds of the photosensitive drums 1Y, 1M and 1C return to the same rotation speed as the photosensitive drum 1K after the adjustment by changing the rotation speeds of the photosensitive drums 1Y, 1M and 1C.

During the period for adjusting the rotation positions, the intermediate transfer belt 8 is separated from the photosensitive drums 1Y, 1M and 1C by the contact mechanism. A shorter period during which the photosensitive drums contact the intermediate transfer belt 8 can contribute to extend the life of the photosensitive drums. Further, for example, during a monochrome image forming using only photosensitive drum 1K, it also contributes for extending the life of the photosensitive drums 1Y, 1M and 1C to keep each photosensitive drum separated from the intermediate transfer belt 8.

An appropriate correlation condition of the rotation positions, which makes a minimum color slippage of the image, may differ due to an individual difference of a printer. Actually, there are individual differences among printers caused by an eccentric error of attachment, an accuracy at a gear molding process, and a speed fluctuation at the joint part between a drive gear and an image carrier.

For this reason, the color slippage of the image is generated because the toner image may stretch and shrink by the fluctuation of the movement of the drum surface. The color slippage of the image becomes maximum when a stretched color toner image is superimposed with another shrunk color toner image. In this example, a correlation of the rotation positions with which the color slippage of the images superimposed on the intermediate transfer belt 8 becomes a minimum value is measured. Then, correlation data based on this measurement is stored in the memory such as the RAM.

More specifically, the controller 40 controls forming a test toner image on each surface of the photosensitive drums 1Y-1K to detect an amount of color slippage of the image. Then, the test toner image is transferred onto the intermediate transfer belt 8. In this example, eight patterns are transferred at every angle of 45 degree as to a rotation position of the photosensitive drum 1K for black color. Each test toner image is read by the read image sensor 36 and is output to the controller 40.

The controller 40 calculates a correlation angle with which the color slippage of the test toner images of the photosensitive drums 1Y-1C becomes a minimum value to the color slippage of the test toner images of photosensitive drum 1K. The calculated correlation angle approximately identifies a correlation of the rotation positions of the photosensitive drums with which the toner images on the photosensitive drums are transferred to the right position on the intermediate transfer belt 8 to make a toner image with minimum color slippage.

As to the test toner image, a stripe pattern is commonly used. The stripe pattern includes dark and light colorings that are repeated in a direction of the length of the intermediate transfer belt 8 with periodic spaces. The exposure apparatus 7 exposes a laser beam L to form the stripe pattern of an electrostatic latent image with periodic spaces. The electrostatic latent image is developed to get a toner image and then the toner image is transferred onto the intermediate transfer belt 8. Finally, the test toner image is formed on the intermediate transfer belt 8.

As a result, the fluctuations such as from the eccentric error of attachment, the accuracy at a gear molding process, and the speed fluctuation at the joint part between a drive gear and an image carrier are reflected in a distance between stripe patterns formed on the intermediate transfer belt 8. The amount of the fluctuations can be known by measuring the distance between stripe patterns.

Other similar procedures may be applicable to get a same result. For example, a portion of the surface of the photosensitive drums, which has a maximum surface velocity, can be used as a base of the correlation. Such a portion of the surface of the photosensitive drums is detected by the measurement of the test toner images.

When the surface portion of each photosensitive drum 1Y, 1M, 1C and 1K which has a maximum surface velocity is detected, the controller 40 generates correlation data to specify the correlation of the rotation position which is used to adjust the toner image to the right position on the intermediate transfer belt 8 so as to achieve the toner image with minimum color slippage.

The surface velocity of the photosensitive drums 1Y, 1M, 1C and 1K changes periodically due to non-uniformity of the surfaces. However, each rotation period is constant. Therefore, it is possible to minimize the slippage between the color toner images transferred onto the intermediate transfer belt 8 by detecting the maximum speed portion of the surface of the photosensitive drum. The data generated with this procedure is stored as the correlation data in the memory.

Each correlation data for an individual printer may be installed at a final process step when the printer is shipped from a factory. However, an amount of color slippage at transfer of an image onto the intermediate transfer belt 8 may change while using the printer. Thus, the color toner slippage is affected by a time dependent factor. Namely, suitable correlation data may differ from the correlation data at the factory shipment of the printer.

To address this problem, a renewal processing to take a correlation data may be scheduled every time the printer prints a predetermined number of papers. The renewal processing includes a series of process steps such as a detection step of the phase difference in the beginning and a generation step of the correlation data at the end.

Moreover, the photosensitive drums 1Y, 1M, 1C and 1K may be removed and installed again at the maintenance service, or a photosensitive drums may be exchanged with new photosensitive drums. In such cases, the appropriate correlation data of the rotation positions to achieve a minimum slippage between photosensitive drums 1Y, 1M, 1C and 1K may change. Therefore, it may also be requested to perform a renewal processing and to store the renewed correlation data in the memory again. In this example, the renewal processing is performed before image processing if at least one of the process cartridges is exchanged.

The drum driving gear 33 is engaged with the photosensitive drum 1 in a direction of the shaft of the photosensitive drum 1 as shown in FIG. 4. In the drum driving gear 33, a projecting portion is formed at a part of drum driving gear 33 to work as a marking to detect the rotation phase. In another word, the projecting portion is an element to be detected and works as a feeler 35.

The drum driving gear 33 is formed to have a disc-like shaped outline. And the drum driving gear 33 is engaged with an end of the photosensitive drum 1 in a longitudinal direction so as to be integrated with the photosensitive drum 1. The drum driving gear 33 is arranged to have an end face to be perpendicular in the main body 3. In this example, the drum driving gear 33 does not include any members or a notch that may cause a fluctuation of the speed.

As a marking member, a feeler or a slit is normally used and is arranged at a part of the drive transfer member in a background printer. A marking is formed at an inner circumference of the end face of the drum driving gear 33 with a predetermined height in a direction of the shaft of the photosensitive drum of FIG. 4.

The feeler 35 is formed as a circumferential member to block a light path. The feeler 35 moves along a circumferential path with a radius in accordance with the rotation of the drum 1Y which is driven by the drive motor 31Y. The positional detection sensor 34 to detect the feeler 35 includes, e.g., a common transparent optical sensor with an optical element that is not affected by electromagnetic phenomenon generated during the image forming process.

As shown in FIG. 4, the positional detection sensor 34 includes an emitting part 34*a* and a receiving part 34*b*. The receiving part 34*b* faces the emitting part 34*a* with a predetermined space to receive a light emitted from the emitting part 34*a*. The positional detection sensor 34 is attached to the main body 3 of the printer A so that the feeler 35 cuts across the light path from the emitting part 34*a* to the receiving part 34*b*. And the output of the positional detection sensor 34 is wired to the controller 40.

At a printing operation, the photosensitive drum 1 is driven to rotate by a rotational force from the drive motor 31. With this rotation of the photosensitive drum 1, the feeler 35 moves in a rotation direction and will pass through the detection area of the positional detection sensor 34 every turn of the photosensitive drum 1. When the feeler 35 goes in the detection area of the positional detection sensor 34, a detection signal is output to indicate a detection of the feeler 35.

In this configuration with one feeler 35, however, if a detecting operation is started at a position in which the feeler 35 is just passing through the detection area of the positional detection sensor 34, a first detection is performed after almost one turn of the photosensitive drum 1. Thus, there may be a delay in printing a first page depending on the position of the feeler 35 relative to the positional detection sensor 34.

For this reason, it is proposed to use a longer feeler and to detect both a start edge 35*a* and an end edge 35*b* of the longer feeler. With this procedure, as shown in FIG. 5, the detection is performed frequently because of detecting both rising edge 16 and falling edge 17 of a detected signal from the positional detection sensor 34. Moreover, it is proposed to arrange a plurality of feelers which have different lengths in the circumferential direction so as to shorten the detection time.

The detection process can then be performed more frequently. The positional detection sensor 34 outputs a detection signal of High level to show an existence of the feeler 35 in the detection area of the positional detection sensor 34 when the feeler 35 enters the detection area and cuts off a beam of light in accordance with the rotation of the photosensitive drum 1.

Further, The positional detection sensor 34 outputs a signal of Low level to show non-existence of the feeler 35 in the detection area of the positional detection sensor 34 when the photosensitive drum 1 rotates further and the feeler 35 passes past the detection area of the positional detection sensor 34. The controller 40 acknowledges a rotational position (rotational angle) of the photosensitive drum 1 in accordance with the detection signal from the positional detection sensor 34.

The ROM in the controller 40 stores a reference data to identify the rotational position. The High level signal shows an approach of the feeler 35 into the detection area of the positional detection sensor 34 when the feeler 35 enters the detection area. Therefore, when the controller 40 receives a detection signal of High level, the controller 40 identifies the rotational position of the photosensitive drum 1 at the starting timing of the receiving signal (at the rising timing of the detected signal) based on the reference data stored in the ROM.

Moreover, the ROM stores data of a time period in which the drum driving gear 33Y and the photosensitive drum 1Y rotate by an angle corresponding to the length of the feeler 35. The length of the feeler 35 is then detected as a time from a timing of the rising edge of the pulse to a timing of the falling edge of the pulse. When the controller 40 receives the Low level of a pulse, the controller 40 can also calculate a corresponding starting time of the High level pulse based on the data of the time period stored in the memory. Namely, the controller 40 identifies the rotation position of the photosensitive drum 1Y even when the Low level of a pulse is only detected.

The output signal from the positional detection sensor 34 can be an opposite value to the example described above. In other words, the controller 40 may receive a Low level while the feeler is detected and may receive a High level while the feeler is not detected. The controller 40 can always figure out the rotational position of the photosensitive drum 1Y even after the detection of the feeler 35 because the photosensitive drum 1Y rotates with a constant speed.

In a background art with a smaller feeler, the weighted center of the drum driving gear is not affected by the weight of the feeler because the feeler is relatively small. In other words, a fluctuation of a weight distribution about the shaft center of the drum driving gear in a direction of the circumference is small in a background device with a smaller feeler.

However, when a larger feeler is installed or a plurality of feelers are attached, the weight balance changes a lot and a weight distribution breadth about the shaft center of the drum driving gear in a direction of the circumference is larger. Therefore, the weighted center of the drum driving gear shifts from the shaft center of the drum driving gear. Moreover, the weighted center of the drum driving gear moves and swings about the shaft center of the drum driving gear during the rotation of the photosensitive drum.

FIGS. 8 and 9 illustrate another example of the drum driving gear with two feelers. The drum driving gear has two feelers 41, 42 which have different lengths and are arranged in a circumferential direction as markings. The weighted center of the drum driving gear is fluctuated from the shaft center because the longer feeler 41 is heavier than the shorter feeler 42. For this reason, the drum driving gear itself becomes a cause of the fluctuation of the speed when the drum driving gear rotates.

More specifically, the two feelers 41, 42 are formed on a concentric circle about the shaft center of the drum driving gear 33. The two feelers 41, 42 are arranged symmetrically so that each segment center of the feelers is positioned at the opposite side about the shaft center. And the segment centers are arranged symmetrically on a line from the segment center of the feeler in a circumferential direction to the shaft center of the drum driving gear. Each feeler has an equal segment length from the segment center of the feeler to both sides with a uniform thickness and height respectively.

Since the two feelers 41, 42 have different segment lengths, there is a large weight difference among the feelers and the weight difference is independent of the other factors such as position of the feelers and sizes. Thus, the weighted center of the drum driving gear is not located at the shaft center of the drum driving gear but is eccentric from the shaft center when the drum driving gear is assembled. Moreover, the weighted center which is eccentric from the shaft center moves with a swing during rotation of the photosensitive drum.

While the relative position of the feelers to the shaft center is moving around in accordance with the rotation of the photosensitive drum, a length of the moment arm stretches and shrinks periodically and a moment force keeps changing. The position of the weighted center of the drum driving gear 33 is affected by this change and moves within a range. Consequently, the position of the weighted center does not stay at an eccentric position.

Generally, the moment force is defined by a product of a force and a distance. In this example, a gravitational force of the weight of each feeler 41, 42 corresponds to the force of the general definition of the moment force. The direction of action of the force is always in a pendent direction. Then, the moment forces of the feelers 41, 42 take a minimum value, a maximum value, a minimum value and a maximum value at positions of one forth turn of one rotation. Moreover, each moment force of the feelers 41, 42 changes repeatedly, decreasing and increasing depending on the position during the rotation of the photosensitive drum.

When any feeler is at a position in which the feeler center on the circumference of a circle crosses the horizontal line from the shaft center, the arm length which corresponds to a distance is an equal size to the radius of the circle and the moment force is a maximum value. On the other hand, when any feeler is at a position in which the feeler center on the circumference of a circle crosses the vertical line from the shaft center, the arm length is equal to zero and the moment force is a minimum value.

Further, the feeler is positioned at a higher intermediate position of one forth of the circle than a horizontal position in accordance with the rotation of the photosensitive drum. In this position, the maximum moment force is added to the drum driving force. Contrarily, if the feeler is positioned at a lower intermediate position of one forth of the circle, the maximum moment force works as a canceling force to the drum driving force.

Further, a centrifugal force of the feelers should be considered when the photosensitive drum rotates faster. Moreover, this centrifugal force of the feelers is not a force that is directed in a fixed direction, but is a force that is always directed in an outer direction from the rotation center.

A summation of a vector force of the centrifugal force and the moment force generates complicated aspects to the weighted center of the drum driving gear. As a result, the feelers 41, 42 affect a rotation body integrated by the photosensitive drum 1 and the drum driving gear 33 and cause a fluctuation of the rotation speed of the rotation body.

In the first exemplary embodiment as shown in FIG. 10, the shorter feeler 43 is arranged to be positioned at a more outer circumference than a circumference for the longer feeler 41 within a range in which the shorter feeler 43 can still pass through the detection area. For example, the shorter feeler 43 may be formed with the original shape by being shifted to the outer direction from the center of the shaft. Namely, the shorter feeler 43 may be placed at a more outer position but still have distance from the previous position within a detection area. Or, the shorter feeler 43 may be formed to fit a circumference of an outer concentric circle and have a same segment length in a direction of circumference keeping symmetrical configuration about the shaft center.

With this configuration, a length of the moment arm of the shorter feeler 43 from the shaft center is longer than a length of the moment arm of the longer feeler 41. The moment of the shorter feeler 43 becomes larger than the moment at the previous position so that the moments of both feelers 41, 43 can balance. Thus, the weighted center of the drum driving gear 33 can be matched with the shaft center.

According to the first exemplary embodiment, the weighted center of the drum driving gear 33 is fit to the shaft center of the drum driving gear so that a fluctuation of the rotation speed of the drum driving gear 33 caused by the drum driving gear 33 itself can be avoided. After this adjustment, phase differences between the photosensitive drums during rotation can be adjusted to match with a measurement data of the phase differences to achieve stability and insure proper performance.

Thus, it is possible to remove a factor of a fluctuation of the rotation speed caused by introducing the element to detect a rotational position of the drum driving gear. As a result, high quality image forming can be provided. In other words, one feeler or both feelers of two feelers that have different lengths may be moved by a distance to be positioned at different positions in an outer radius direction.

Then, the moment center is adjusted to be located at the shaft center of the drum driving gear so that the fluctuation of the rotation speed caused by the drum driving gear itself can be avoided without changing the weights of the feelers. Thus, this merit is obtained simply by the structure change of the location of the feelers without adding any member. Consequently, this structured can realize a low cost and light weight solution.

Contrary to the first exemplary embodiment, the longer feeler may be arranged to be positioned on a more inner circumference than a circumference for the shorter feeler within a range in which the longer feeler can still pass through the detection area of the drum driving gear. The longer feeler having an original length can be placed on an inner circumference with a smaller radius. Both feelers may also be arranged at different positions from the original circumference, especially when a size difference between the feelers is large.

It has been explained that the longer feeler is used to detect a rotational position in the first exemplary embodiment. However, the shorter feeler can be used for the detection as well. It is possible to detect the rotational position when there is enough length difference in a circumferential direction between the feelers.

In a second exemplary embodiment, feelers have adjusted weights and are positioned at original positions on a circumference. As one example, the weights of the feelers are adjusted by having a lowered height for a longer feeler or to have a higher height for a shorter feeler so that the moment balances and the weighted center of the drum driving gear 33 match with the shaft center of the photosensitive drum.

Figure 11:
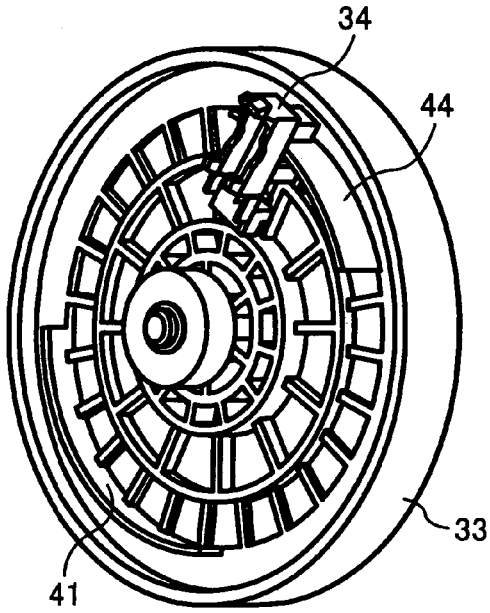
FIG. 11 illustrates an oblique perspective view of a drum drive gear of another exemplary embodiment of the present invention.
Figure 12:
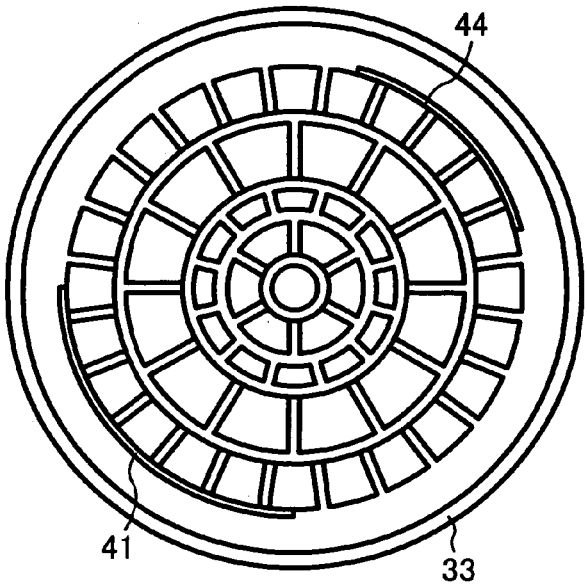
FIG. 12 is a magnified front view of the drum drive gear of FIG. 11.

A height of the projection of the longer feeler may be formed lower than a height of the projection of the shorter feeler. A weight reduction of the longer feeler can be achieved by lowering the height of the longer feeler, as shown in FIGS. 11 and 12. A height of the projection of the shorter feeler may be formed higher than a height of the projection of the longer feeler. A weight increase of the shorter feeler can thereby be achieved by heightening the shorter feeler. Further, a combination of both procedures described above can be taken.

The two feelers 41, 44 having an equivalent weight from each other are placed axisymmetrically about the rotation center of the drum driving gear with a same distance from the shaft center. The moment forces due to the two feelers 41, 44 are then equivalent. And the weighted center of the system including the moment forces is positioned at the center of the photosensitive drum. Accordingly, the center of the weight and the moment balance of the drum drive gear due to the two feelers 41, 44 can be matched to the center of the photosensitive drum.

Figure 13:
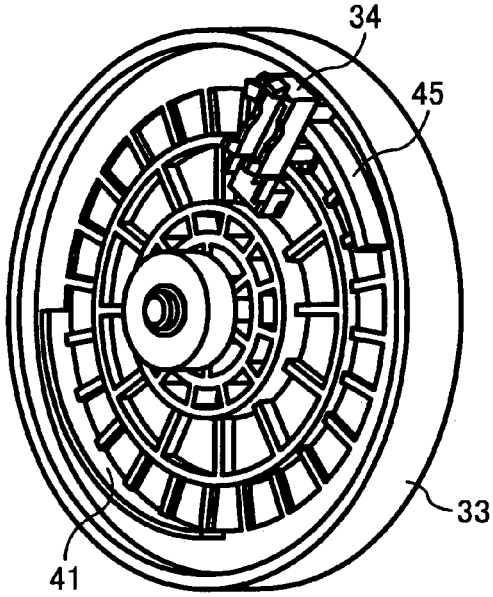
FIG. 13 illustrates an oblique perspective view of a drum drive gear of another exemplary embodiment of the present invention.
Figure 14:
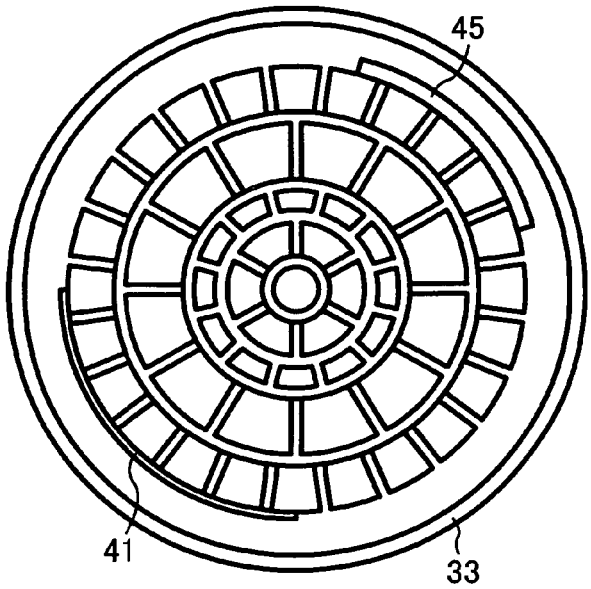
FIG. 14 is a magnified front view of the drum drive gear of FIG. 13.

Thicknesses of the feelers may also be changed to adjust a weight of the feelers as an alternative of the second exemplary embodiment. The shorter feeler may be formed thicker than the longer feeler as shown in FIGS. 13 and 14. In this case, the weight of the shorter feeler increases due to the feeler thickness or material.

Similarly, the two feelers 41, 45 having an equivalent weight from each other can be placed axisymmetrically about the rotation center of the drum driving gear with a same distance from the shaft center. The moment forces due to the two feelers 41, 45 are equivalent. The weighted center of the system including the moment forces is positioned at the center of the photosensitive drum. Accordingly, the center of the weight and the moment balance of the drum driving gear due to the two feelers 41, 45 can be matched to the center of the photosensitive drum.

According to the second exemplary embodiment, the weighted center of the drum driving gear is fitted in the shaft center of the drum driving gear so that the fluctuation of the rotation speed caused by the drum driving gear itself can be avoided. Thus it is possible to eliminate a phase difference between the photosensitive drums during rotation with measurement data of the phase differences so as to achieve stability and insure proper performance.

Namely, it is possible to remove a factor of a fluctuation of the rotation speed caused by introducing the element to detect a rotational position of the drum driving gear. As a result, high quality image forming can be provided. In the second exemplary embodiment, the thickness of the shorter feeler is increased to an outer side by an amount to still have a possible space through which the shorter feeler can pass. However, it is also possible to increase the thickness to the inner side or a combination of increases to both sides.

Figure 15:
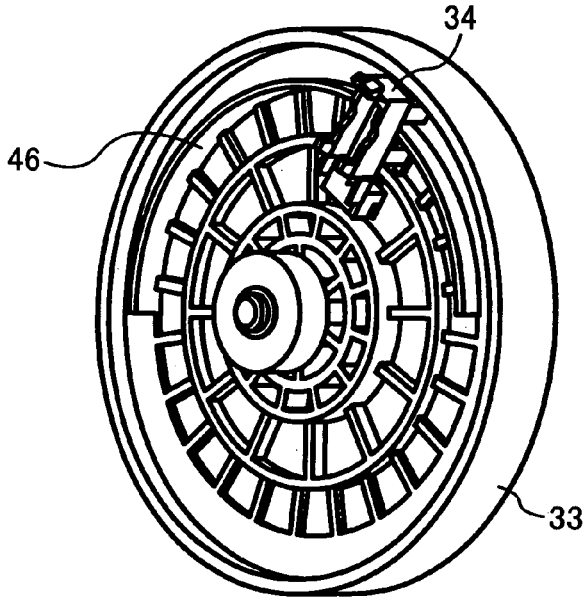
FIG. 15 illustrates an oblique perspective front side view of a drum drive gear of another exemplary embodiment of the present invention.
Figure 16:
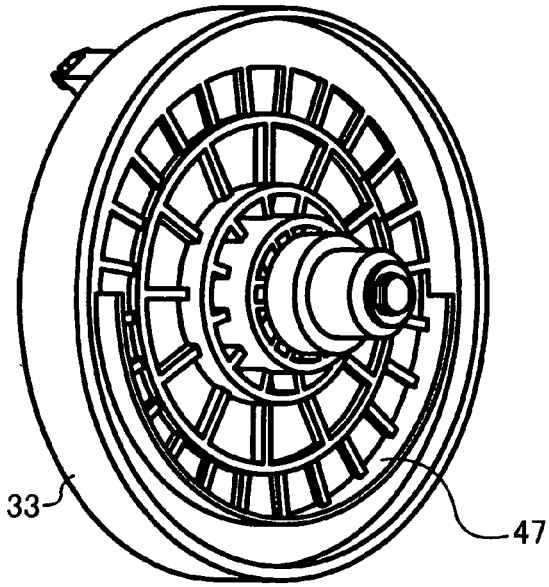
FIG. 16 illustrates an oblique perspective backside view of the drum drive gear of FIG. 15.

In a third exemplary embodiment, an assistant feeler is arranged in a backside of the plane of the driving transfer member on which the detection member is not arranged. The assistant feeler has a similar shape of the marking feeler for detection of the rotational position, but is not used to detect the rotational position. More specifically, an assistant feeler 47, which has a same shape as a marking feeler 46 used to detect the drum driving gear 33, is arranged on the opposite side of the plane, a side on which no marking feeler is arranged, as shown in FIGS. 15 and 16. The assistant feeler 47 is placed at an axisymmetrical position to the marking feeler 46 about the drum driving gear 33.

In other words, the drum driving gear has two planes, a front side plane and a back side plane. The marking feeler 46 is arranged on the front side plane, which does not face a plane of the photosensitive drum 1. The assistant feeler 47 having a same shape as the marking feeler 46 is arranged on the back side plane in an axisymmentical position to the marking feeler 46.

The assistant feeler 47 is formed with a same shape and having a same height, thickness, and length in a direction of the circumference as the marking feeler 46; the only exception with the marking feeler 46 is its position. The assistant feeler 47 is not arranged in the same plane, i.e. in the front side plane, but is arranged in the back side plane.

Moreover, a segment center of the assistant feeler 47 is placed axisymmentically to a segment center the marking feeler 46. And the assistant feeler 47 extends in a direction of the circumference with an equal length from the segment center. In the third exemplary embodiment, the feelers are formed to have large lengths to be almost equal to a half of a whole circumference.

The two feelers 46, 47 having an equivalent weight and placement are placed axisymmetrically about the rotation center of the drum driving gear with a same distance from the shaft center. The moment forces of the two feelers 46, 47 are thereby equivalent. The weighted center of the system including the moment forces is positioned at the center of the photosensitive drum. Accordingly, the center of the weight and the moment balance of the drum driving gear due to the two feelers 46, 47 can be matched to the center of the photosensitive drum.

According to the third exemplary embodiment, it is possible to adjust the weighted center of the drum driving gear to the shaft center of the drum driving gear, compared to when only one feeler is used. This embodiment may be beneficial when it is difficult to arrange an assistant feeler for a balance on the same side of the plane due to, for example, a detecting condition of a detecting sensor.

In other words, it is possible to make the weighted center of the drum driving gear matched to the shaft center of the drum driving gear when only one feeler is used and when a size difference of the feelers is too large to make a moment balance by a simple shift of the feeler. As a result, the fluctuation of the rotation speed caused by the drum driving gear itself can be avoided and a driving control can be performed accurately and can provide a high quality image forming.

Further, when a plurality of marking feelers are arranged asymmetrically about the shaft center on one side plane, similar results can be obtained by placing a plurality of corresponding assistant feelers having same shapes on the other side of the plane. Thus, it is possible to have a high flexibility in configuration and placement of the marking feelers.

Namely, a choice for the positional detection sensors can be expanded with relaxed limitations of detecting conditions. Further, an accuracy for detection of the rotational position can be improved.

In the third exemplary embodiment, the similar feeler having the same shape is arranged axiasymmetrically on the back side of the drum driving gear as an assistant feeler, instead of arranging an equivalent member which has an equivalent weighted center to the marking feeler by calculating the moment force under consideration of shape and position. Therefore, designing and manufacturing the drum driving gear is easier to realize a stable moment balance because a complicated calculation for an adjustment of the moment force is not needed.

As explained in the third exemplary embodiment, the marking feeler for detecting the rotational position is arranged on the front side plane which does not face a plane of the photosensitive drum. And the assistant feeler having the same shape as the marking feeler is arranged on the back side plane in an axisymmentical position to the marking feeler.

However, an opposite configuration is also possible. More specifically, a marking feeler for detecting the rotational position can be placed on the back side plane and a corresponding assistant feeler having same shape can be placed on the front side plane.

In a fourth exemplary embodiment, a marking feeler is provided as a different component. The marking feeler is made of a different material from a material of the drum driving gear or another feeler so that a weight of the marking feeler can be different from a weight of the another feeler. Even if the marking feeler has a same shape as another feeler, the feeler can have a different weight so that the weighted center of the drum driving gear is adjusted to the shaft center of the drum driving gear.

Figure 17:
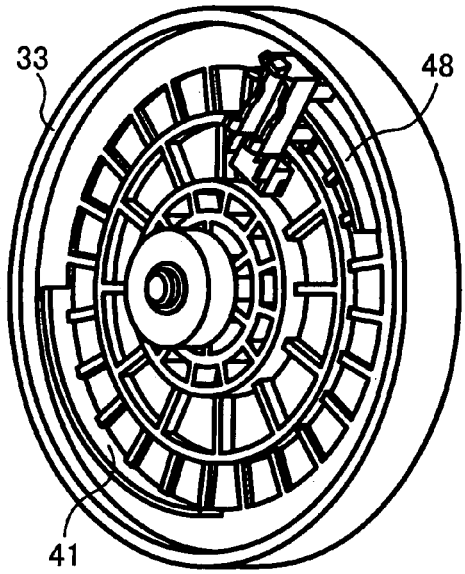
FIG. 17 illustrates an oblique perspective view of a drum drive gear of another exemplary embodiment of the present invention.
Figure 18:
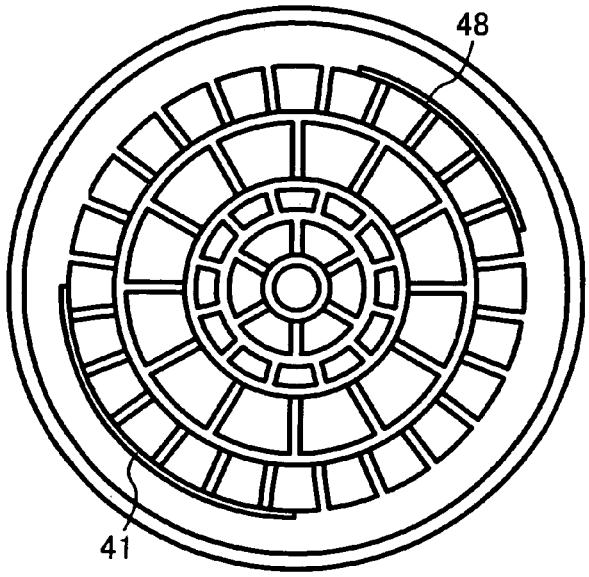
FIG. 18 illustrates a magnified front view of the drum drive gear of FIG. 17.

As shown in FIGS. 17 and 18, a longer marking feeler 41 for a detection is configured to be integrated with the drum driving gear 33 and is formed with a synthetic resin, which is the same as the material of the drum driving gear 33. The shorter assistant feeler 48, which is for a balance with the corresponding marking feeler 41, is formed of a predetermined different material from the material of the marking feeler so as to make the weight of the shorter assistant feeler 48 match the weight of the longer marking feeler 41.

Therefore, the two feelers 41, 48 having an equivalent weight from each other are placed axisymmetrically about the rotation center of the drum driving gear 33 with a same distance from the shaft center. The moment forces due to the two feelers 41, 48 are equivalent. The weighted center of the system including the moment forces is positioned at the center of the photosensitive drum. Accordingly, the weighted center and the moment balance of the drum driving gear due to the two feelers 41, 48 can be matched to the center of the photosensitive drum 33.

According to the fourth exemplary embodiment, it is possible to adjust the weighted center of the drum driving gear to the shaft center of the drum driving gear, when a size difference of the feelers is too large to make a moment balance simply by a shift of the feeler. As a result, the fluctuation of the rotation speed caused by the drum driving gear itself can be avoided and a driving control can be performed accurately and can provide a high quality image forming.

The material used for the assistant feeler 48 is not limited to a fixed material but equivalents that operate in a similar manner are applicable. However, it is better to select a material that does not affect an electromagnetic circumstance during the image forming process. The material to be used may be selected among nonmagnetic materials with a consideration of types of synthetic resin.

In the fourth exemplary embodiment, a material of the shorter feeler having a lighter weight is changed to increase its weight to make a weight balance. However, it is also possible to make a weight balance by changing a material of the longer feeler having a heavier weight to decrease its weight. Further, a combination of a weight increase of the shorter feeler and a weight reduction of the longer feeler can also be implemented.

Figure 19:
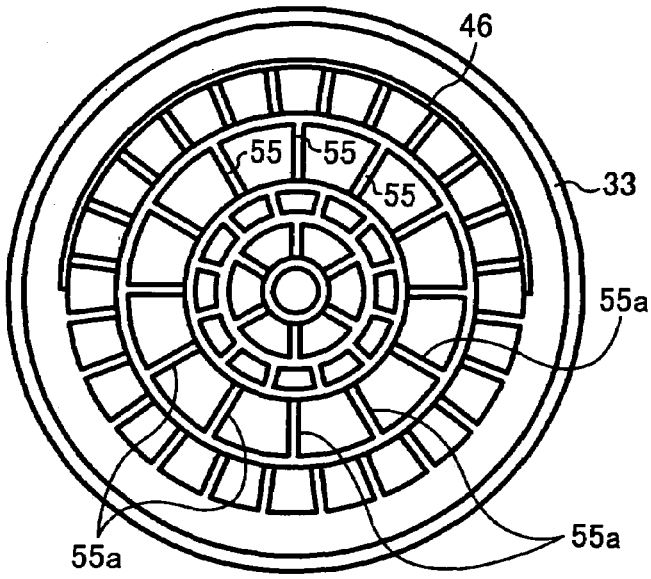
FIG. 19 is a magnified front view of a drum drive gear of another exemplary embodiment of the present invention.
Figure 20:
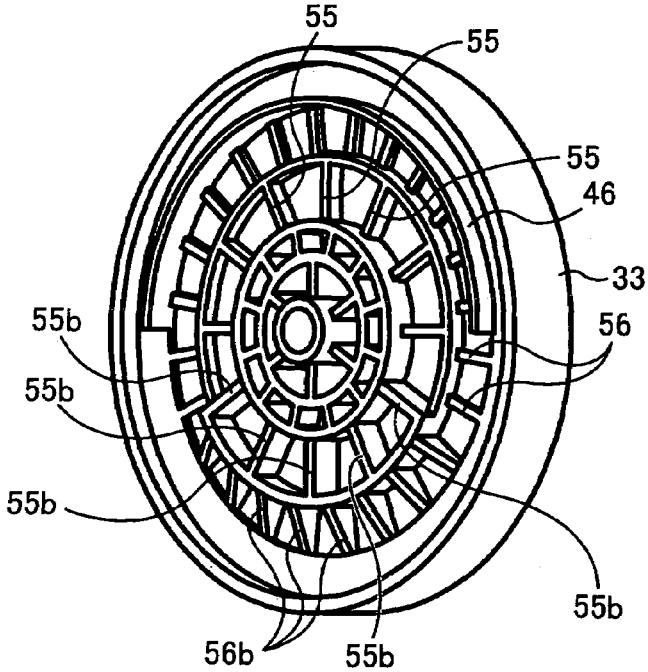
FIG. 20 illustrates an oblique perspective view of a drum drive gear of another exemplary embodiment of the present invention.

In a fifth exemplary embodiment, a part of the drum driving gear is formed to be higher or thicker so that a weight balance of the drum driving gear is achieved. As shown in FIGS. 19 or 20, some of the strengthening ribs 55*a* of the drum driving gear are formed to have a different thickness from a thickness of other strengthening ribs 55 to balance the weight so that a weighted center of the drum driving gear matches a shaft center of the photosensitive drum.

The drum driving gear is formed with five concentric rings in the fifth exemplary embodiment. The radiuses of the outer concentric rings are formed larger one by one from the shaft center. An even number of the strengthening ribs are arranged at regular intervals between concentric rings. The number of the strengthening ribs are increased in a predetermined manner. Similar to the third exemplary embodiment, the feeler 46 is formed to have a length to be almost equal to a half of a whole circumference of the ring on which the feeler is arranged.

More specifically, as to a change of the thickness of the strengthening ribs, the five strengthening ribs 55*a*, which are located axisymmetrically to the detection feeler 41, are selected among the twelve strengthening ribs 55. The selected five strengthening ribs 55*a* are formed to be thicker than the other strengthening ribs by a predetermined amount, as shown in FIG. 19. The summation of moments by the thicker strengthening ribs is set to be equal to a moment due to a weight of the feeler 46.

At first, a strengthening rib axisymmetrical to a segment center of the feeler 46 is selected. Then, four more strengthening ribs, which are located symmetrically to the segment center and on both sides of the feeler 46, are selected. Thus, the five thick strengthening ribs are arranged.

FIG. 20 illustrates another example of the fifth exemplary embodiment. More specifically, strengthening ribs 55*b* are formed to have larger heights than the other strengthening ribs in a direction of the shaft. Five strengthening ribs 55*b*, which are located axisymmetrically to the detection feeler 46, are selected among the twelve strengthening ribs 55. The selected five strengthening ribs 55*b* are formed to be higher than the other strengthening ribs by a predetermined amount.

Additionally, a ring connected to the five strengthening ribs 55*b* with an outer side of the strengthening ribs 55*b* is formed to have a larger height similarly to the selected strengthening ribs 55*b*. Eight strengthening ribs 56*b* of an outermost circumference are connected to the five strengthening ribs 55*b* and are formed not to be flat but to be slanted shapes so as to have triangular shaped parts.

The summation of moments due to the increase of height of the strengthening ribs and the increase of the triangular shaped part of outermost strengthening ribs is set to be equal to a moment due to a weight of the feeler 46. Namely, heights of an inner edge of the strengthening rib 56*b* is the same as a height of the selected strengthening rib 55*b* and an outer edge of the strengthening rib 56*b* is the same as a height of an outermost ring, which does not have higher height so as to have triangular shaped parts. In this example, the five strengthening ribs are selected and formed differently to make a moment balance.

Therefore, in the two above examples, the increased portions of strengthening ribs 55*a* or strengthening ribs 55*b* and triangular shaped parts are corresponding weight balancing members. The increase of the strengthening ribs having an equivalent weight are placed axisymmetrically about the rotation center of the drum driving gear with a same distance from the shaft center. The moment forces due to the increased portions of strengthening ribs 55*a* or strengthening ribs 55*b* and triangular shaped parts are equivalent to the moment force due to the feeler 46. The weighted center of the system including the moment forces is thereby positioned at the center of the photosensitive drum.

Accordingly, the center of the weight and the moment balance of the drum driving gear due to the feeler 41, the increased portions of strengthening ribs 55*a* or strengthening ribs 55*b* and triangular shaped parts 55*b* can be matched to the center of the photosensitive drum.

According to the fifth exemplary embodiment, it is possible to adjust the weighted center of the drum driving gear to the shaft center of the drum driving gear, when only one feeler is used and when a size difference of the feelers is too large to make a moment balance by a simple shift of the feeler. As a result, the fluctuation of the rotation speed caused by the drum driving gear itself can be avoided and a driving control can be performed accurately and can provide a high quality image forming.

In the above described exemplary embodiments, as the photosensitive drum is integrated in a process cartridge, a fluctuation of the rotation speed of the photosensitive drum tends to affect more than other process units. However, taking this configuration, the weighted center of the drum driving gear can be matched to the center of the photosensitive drum and can provide a high quality image forming.

Accordingly, it is possible to remove the fluctuation of the rotation speed of the photosensitive drum due to a shift of the weighted center of the drum driving gear because the weighted center of the drum driving gear is matched to the shaft center of the photosensitive drum. As a result, it is possible to avoid process cartridges affecting each other. At the same time, a color slippage due to the fluctuation of the rotation speed of the photosensitive drum can be reduced and it is possible to provide a high quality image forming.

In the exemplary embodiments, the examples are illustrated using an image forming apparatus with an intermediate transfer belt, but the teachings are also applicable to image forming apparatuses with other types of intermediate transfer bodies such as a large intermediate transfer drum. Moreover, this is also applicable to an image forming apparatus in which a toner image is transferred directly to paper fed by a paper feed mechanism instead of using an intermediate transfer belt. In this case, it may be requested to form a test image which can be erased at a belt cleaning apparatus, and that can be detected to generate information to identify the rotational position.

Further, it is applicable to any image forming apparatus which includes a plurality of photosensitive units to make a toner image by superimposing images transferred by adjusting rotational phases.

Any combination of the procedures described in the exemplary embodiment can be applicable. For example, in the case of usage of two feelers, a height of an assistant feeler for balance can be increased by corresponding amount to balance a weight. Or, a thickness of the assistant feeler may be increased by the necessary amount. Further, the assistant feeler may be shifted, or strengthening ribs may be adjusted by increasing the height and the thickness. Any combination of such approaches can be utilized.

Numerous additional modifications and variations are possible in light of the above teachings. It is therefore to be understood that within the scope of the appended claims, the disclosure of this patent specification may be practiced otherwise than as specifically described herein.

The invention claimed is:

1. An image forming apparatus comprising:

a plurality of process cartridges each of which includes, an image carrier configured to form an image intermediately, a drive transfer member engaged with the image carrier, a drive mechanism configured to drive to rotate the image carrier via the drive transfer member, a marking member mounted on the drive transfer member and configured to indicate a rotational position of the drive transfer member, a detector configured to detect the rotational position by detecting the marking member, a balancer mounted on the drive transfer member configured to match a weighted center of the drive transfer member with a shaft center of the image carrier, the balancer and marking member being mounted on opposite front and back sides of the drive transfer member, and a controller configured to adjust rotational phases of the image carriers based on results detected by the detector.

2. The image forming apparatus according to claim 1, wherein the balancer is mounted on a different circumference of the drive transfer member from a circumference on which the marking member is mounted.

3. The image forming apparatus according to claim 1, wherein the balancer has a different height than of the marking member.

4. The image forming apparatus according to claim 1, wherein the balancer has a different thickness than of the marking member.

5. The image forming apparatus according to claim 1, wherein the balancer is made of a different material than of the marking member.

6. The image forming apparatus of claim 1, wherein the balancer comprises:

a plurality of strengthening ribs configured to strengthen the drive transfer member, wherein at least one of the strengthening ribs has a different height from a height of other strengthening ribs so that a weighted center of the drive transfer member matches with a shaft center of the image carrier.

7. The image forming apparatus of claim 1, wherein the balancer comprises:

a plurality of strengthening ribs configured to strengthen the drive transfer member, wherein at least one of the strengthening ribs has a different thickness than a thickness of other strengthening ribs so that a weighted center of the drive transfer member matches with a shaft center of the image carrier.

8. The image forming apparatus according to claim 1, wherein each process cartridge which includes the image carrier is removable.

9. The image forming apparatus according to claim 1, wherein the marking member is a first feeler member protruding from the drive transfer member and the balancer is a second feeler member protruding from the drive transfer member and mounted on a different circumference of the drive transfer member from a circumference on which the first feeler member is mounted.

10. The image forming apparatus according to claim 1, wherein the marking member is a first feeler member protruding from the drive transfer member and the balancer is a second feeler member having a different height than of the first feeler member.

11. The image forming apparatus according to claim 1, wherein the marking member is a first feeler member protruding from the drive transfer member, and the balancer is a second feeler member protruding from the drive transfer member and having a different thickness than of the first feeler member.

12. The image forming apparatus according to claim 1, wherein the marking member is a first feeler member protruding from the drive transfer member and the balancer is a second feeler member protruding from the drive transfer member and mounted on another side of the drive transfer member from which the first feeler member is mounted.

13. The image forming apparatus according to claim 1, wherein the marking member is a first feeler member protruding from the drive transfer member, and the balancer is a second feeler member protruding from the drive transfer member and made of a different material than of the first feeler member.

14. The image forming apparatus of claim 1, wherein the marking member is a first feeler member protruding from the drive transfer member and the balancer comprises:

a plurality of strengthening ribs configured to strengthen the drive transfer member, wherein at least one of the strengthening ribs has a different height from a height of other strengthening ribs so that a weighted center of the drive transfer member matches with a shaft center of the image carrier.

15. The image forming apparatus of claim 1, wherein the marking member is a first feeler member protruding from the drive transfer member and the balancer comprises:

a plurality of strengthening ribs configured to strengthen the drive transfer member, wherein at least one of the strengthening ribs has a different thickness than a thickness of other strengthening ribs so that a weighted center of the drive transfer member matches with a shaft center of the image carrier.

16. An image forming apparatus comprising:

a plurality of process cartridges each of which includes, image camer means for forming an image intermediately, drive transfer means engaged with the image carrier means, driving means for driving to rotate the image carrier means via a drive transfer means, marking means mounted on the drive transfer means for indicating a rotational position of the drive transfer means, detecting means for detecting the rotational position by detecting the marking means, balancing means for matching a weighted center of the drive transfer means with a shaft center of the image carrier means, the balancing means and marking means being mounted on opposite front and back sides of the drive transfer member, and control means for adjusting rotational phases of the plurality of image carrier means based on results detected by the detecting means.

* * * * *